United States Patent [19]

Strohbeen

[11] 4,440,259

[45] Apr. 3, 1984

[54] LOUDSPEAKER SYSTEM FOR PRODUCING COHERENT SOUND

[76] Inventor: John Strohbeen, 160 Bergen St., Brooklyn, N.Y. 11211

[21] Appl. No.: 290,956

[22] Filed: Aug. 7, 1981

[51] Int. Cl.[3] ..... H04R 1/28

[52] U.S. Cl. ..... 181/146; 181/153

[58] Field of Search ..... 181/145–146, 181/151, 153, 199, 144; 179/115.5 R, 146 E

[56] References Cited

U.S. PATENT DOCUMENTS

| | | | |
|---|---|---|---|
| 3,076,520 | 2/1963 | Farwell | 181/145 |
| 3,424,873 | 1/1969 | Walsh | 179/115.5 R |
| 3,477,540 | 11/1969 | Rizo-Patron | 181/144 X |
| 3,816,672 | 6/1974 | Gefvert et al. | 179/115.5 R |
| 3,935,402 | 1/1976 | Gersten | 179/115.5 VC |
| 4,134,471 | 1/1979 | Queen | 181/147 |
| 4,157,741 | 6/1979 | Goldwater | 181/159 |
| 4,182,429 | 1/1980 | Senzaki | 181/144 |

FOREIGN PATENT DOCUMENTS

| | | |
|---|---|---|
| 859408 | 10/1977 | Belgium . |
| 2001379 | 7/1970 | Fed. Rep. of Germany . |
| 2605936 | 8/1977 | Fed. Rep. of Germany . |
| 2274194 | 7/1974 | France . |

OTHER PUBLICATIONS

Julié, Minimizing Interference Effects in Tweeters and Tweeter-Woofer Combinations, IEEE Transactions on Audio, Mar.-Apr. 1964, pp. 30–35.

*Primary Examiner*—Thomas H. Tarcza

*Attorney, Agent, or Firm*—Philip H. Gottfried

[57] ABSTRACT

A loudspeaker apparatus is provided for producing time and phase-coherent sound waves, substantially hemispherical in shape, directed toward a listening area. The loudspeaker apparatus includes a simply-constructed, inverted speaker cone designed to produce primarily low and medium frequencies, a high frequency speaker uniquely positioned above and behind the axis of the cone to supplement the high frequencies, and absorbing material disposed inter alia at a rear portion and at the smaller end of the cone to produce the hemispherical-shaped sound waves and direct them toward the listening area.

18 Claims, 11 Drawing Figures

FIG.4
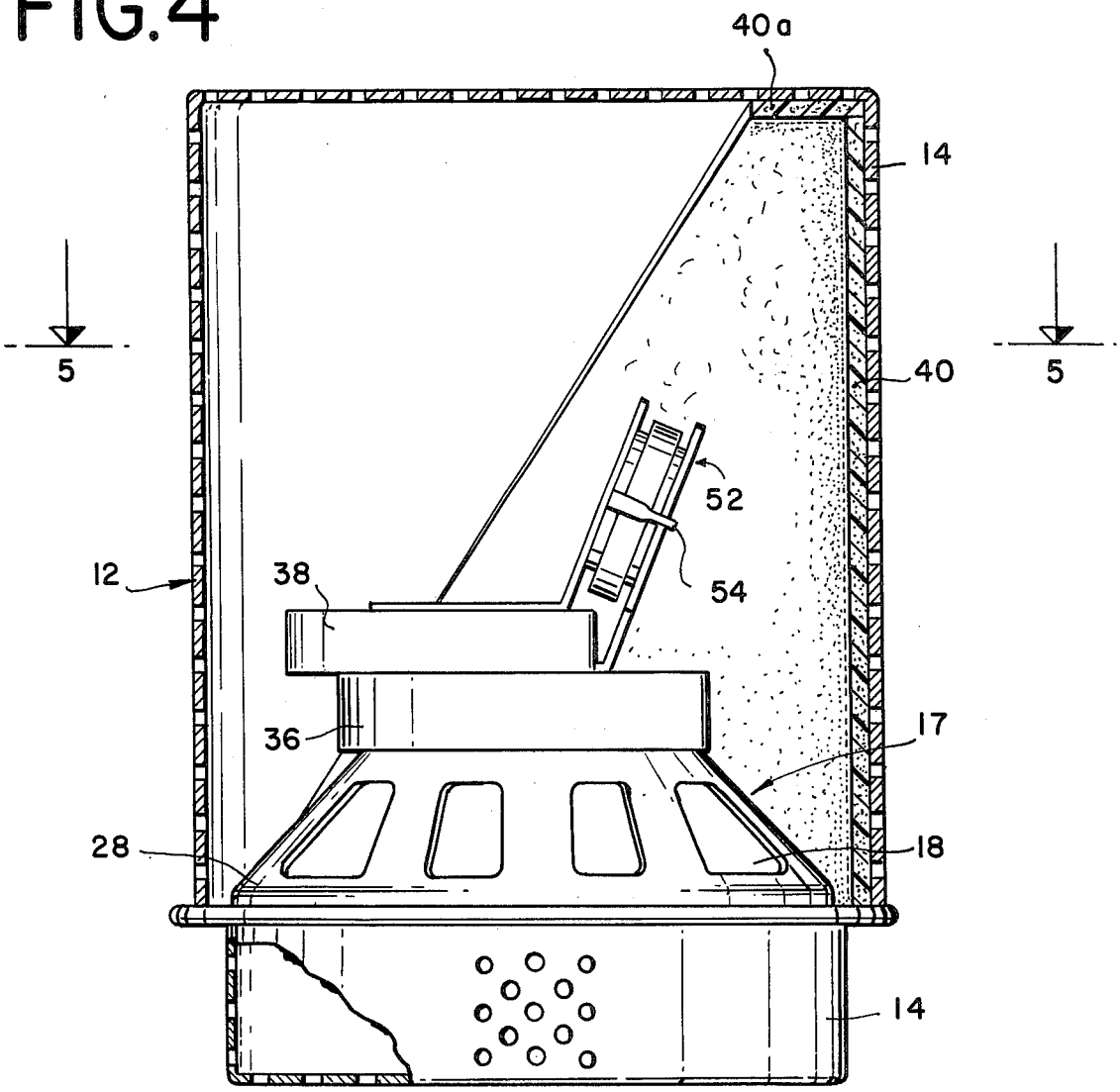
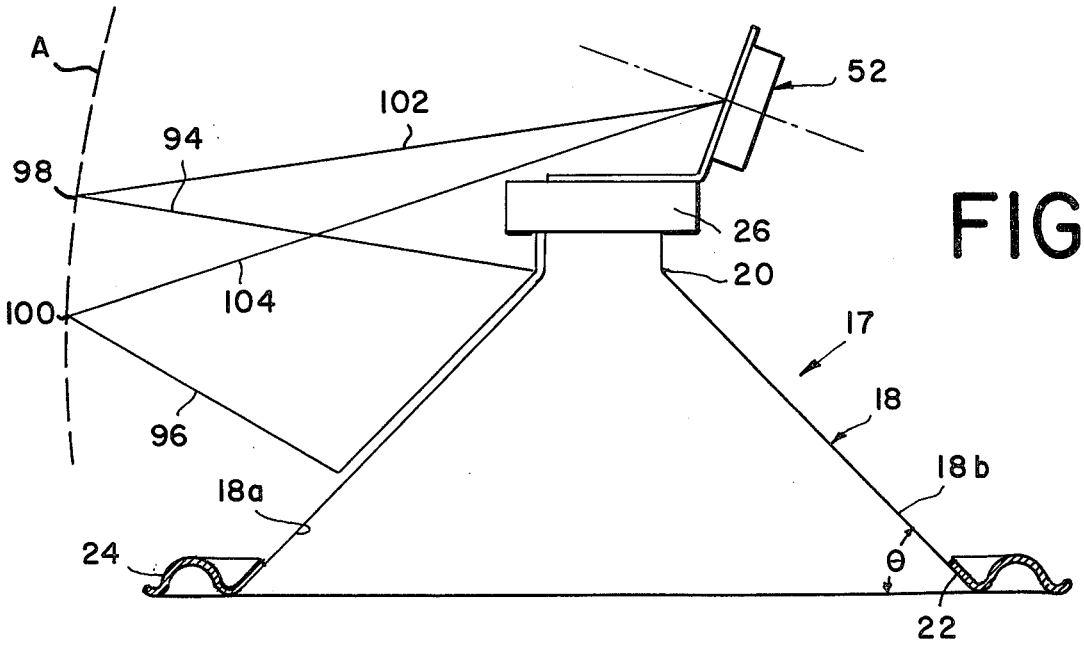
FIG.6

FIG. 5
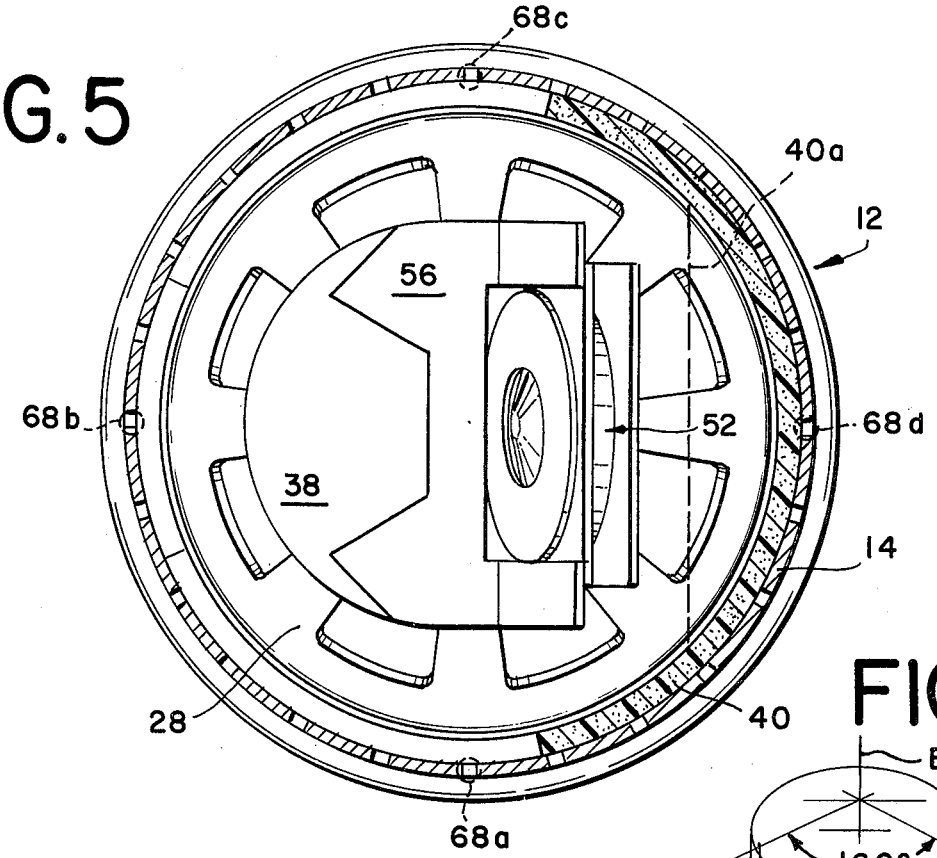
FIG. 11
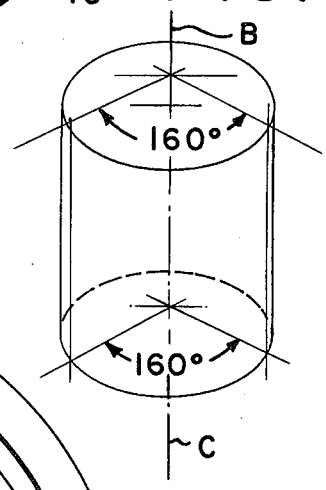
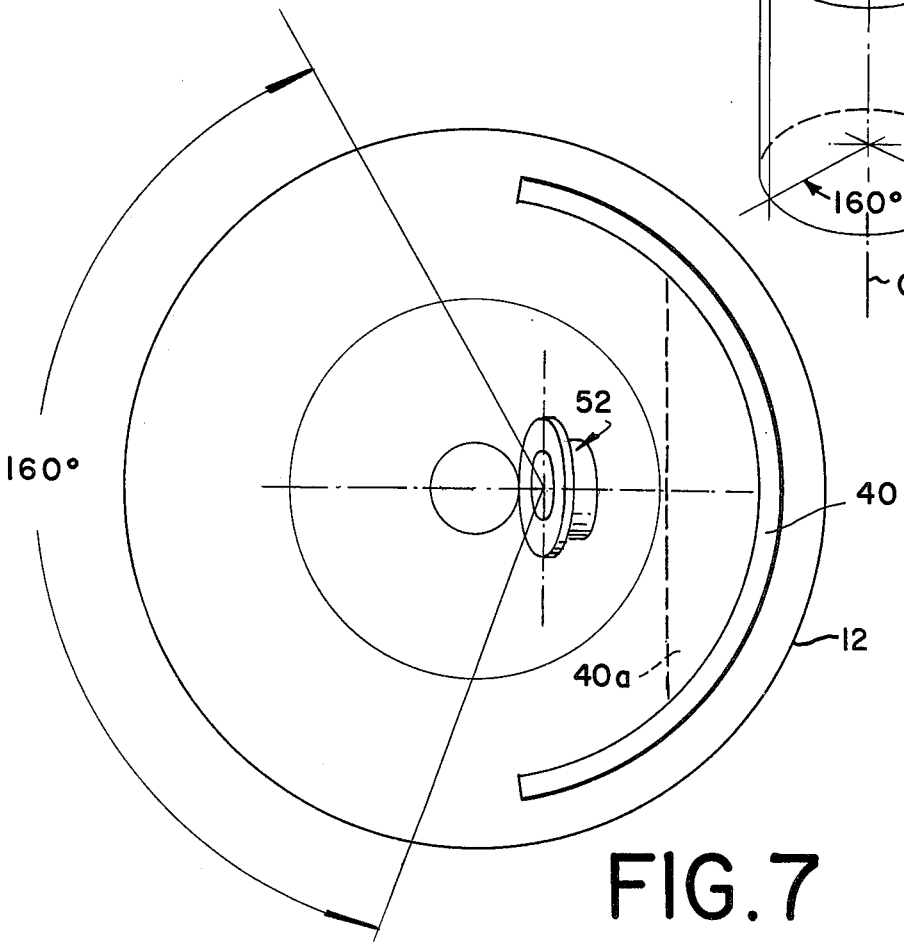
FIG. 7

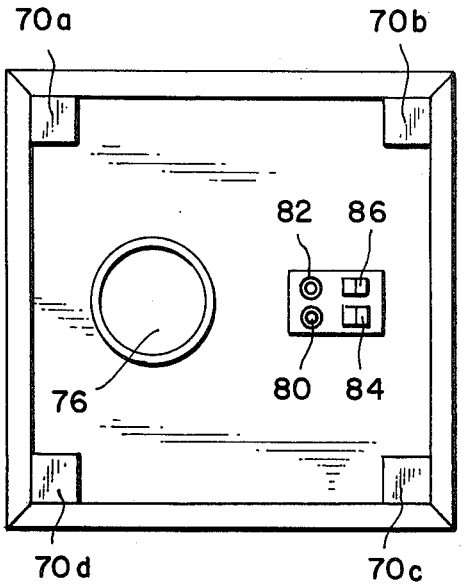
FIG. 8
FIG. 10
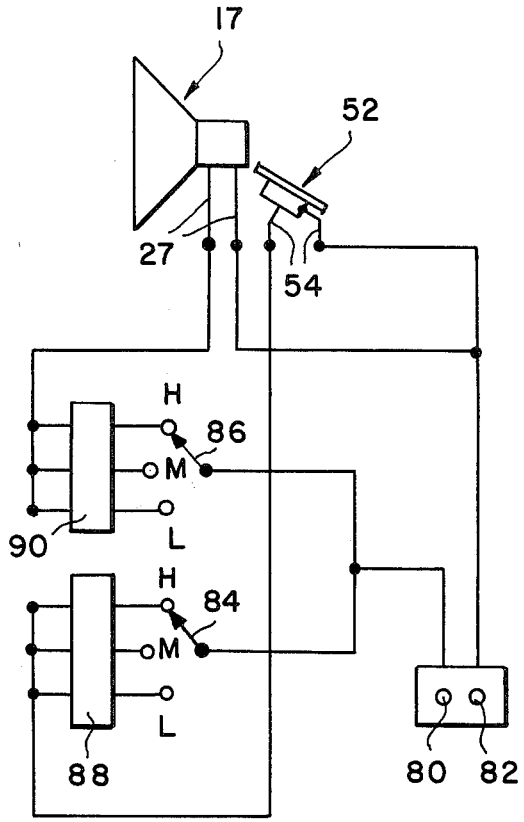
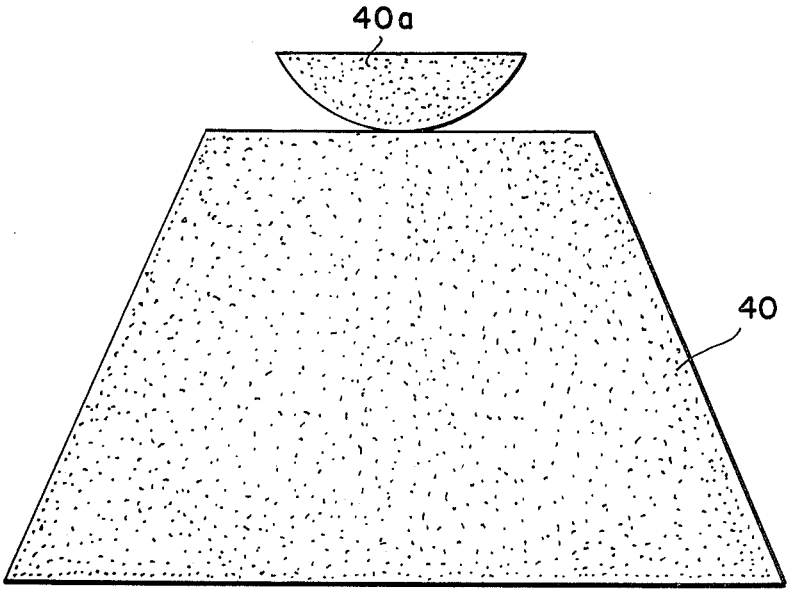
FIG. 9

LOUDSPEAKER SYSTEM FOR PRODUCING COHERENT SOUND

The present invention relates generally to a loudspeaker system that produces time and phase-coherent sound waves and in particular to a system that uniquely uses an inverted speaker cone to produce primarily low and medium frequencies, a conventional high frequency speaker in unusual juxtaposition with the inverted speaker cone to supplement the high frequencies, and absorbing material uniquely disposed with respect to the cone to produce coherent sound waves, substantially hemispherical in shape, directed toward the listening area.

A typical, conventional loudspeaker system comprises at least two, and frequently, three speakers for producing low (woofer), medium (mid-range) and high (tweeter) frequency sounds. It is known that there are different lag times for different speakers. Lag exists as a result of the difference between the time when an electrical audio-analagous signal is received by a voice coil of a speaker and the speaker responding. That lag varies depending inter alia on the voice coil mass. It is known to attempt to compensate for this difference in lag time among each of the component speakers in a loudspeaker system in an attempt to produce a coherent sound wave. In some such prior art systems the woofer is placed closest to the listening area (its voice coil or driver has the greatest mass and therefore the greatest lag), the mid-range is placed further away (its voice coil or driver has a lesser mass and therefore its time delay is less) and the tweeter is placed furthest away (its coil or driver is the lightest, and therefore it suffers the least delay or lag) in order to compensate for the different lag times of the different speakers in the system.

However, in such conventional loudspeaker systems, if the tweeter is placed behind the woofer with respect to the listening area, the woofer blocks some of the sound directed to the listening area. Alternatively, if the tweeter is placed to the side of the woofer so as not to have the woofer block the sound to the listening area, there is only a relatively small (typically $1'' \times 1'' \times 1''$) area where there is any coherent sound since a conventional speaker produces only a partially-spherical wave front. In view of the placement problems and different lag times of each of the component speakers, there is noncoherence of the sound produced and heard in the listening area. This is undesireable as it produces unrealistic sound.

It is also known that a time and phase-coherent cylindrical-shaped sound wave can be produced by an omnidirectional inverted speaker cone which is capable of producing essentially the entire audible frequency spectrum from a single albeit expensive and complex source. An inverted speaker cone of this type is disclosed in U.S. Pat. No. 3,424,873 ("the '873 patent") to Walsh. The speaker disclosed in the '873 patent requires that sound waves travel down the outer convex surface of the inverted speaker cone a significant number of times faster than the speed of sound in the surrounding medium, i.e., air, producing sound waves which radiate outwardly from the cone and which are cylindrically-shaped. The advantageous properties of this speaker result from a suitable choice of materials of which the cone is composed (usually metal in combination with other materials) to eliminate extraneous vibrations, the geometry of the cone, and the choice of a very low mass, high energy voice coil (which is extremely expensive) of the type disclosed in U.S. Pat. No. 3,935,402 to Gersten, which greatly reduces the lag time between the input of an audio signal and the movement of the cone. Such an omnidirectional speaker, however, is necessarily of a large size, includes specialized components and requires hand assembly, making it extremely expensive. Moreover, to fully realize the advantageous properties of the speaker, room placement may be critical.

It is an object of the present invention to provide an apparatus for producing coherent sound waves, substantially hemispherical in shape, directed to the listening area.

It is a more particular object of the present invention to provide an apparatus for producing time and phase-coherent sound waves using a simply-constructed inverted speaker cone designed to produce low and medium frequencies, a conventional high frequency speaker uniquely positioned above and behind the axis of the cone to supplement the high frequencies, and absorbing material disposed at a rear portion and the smaller end of the cone to produce sound waves, substantially hemispherical in shape, directed to the listening area.

It is still a further object of the present invention to accomplish the foregoing objects economically and with a simply designed apparatus.

In accordance with an illustrative embodiment demonstrating the objects and features of the present invention, there is provided an inverted speaker cone which has two coaxial ends defining an inner concave and an outer convex sound radiating surface therebetween. The inverted cone has the property that sound wave fronts propagate along its outer surface at a speed greater than the speed of sound in the surrounding medium. Driving means coupled to the Cupper, smaller end of the cone produces vibrating movement of the cone. Absorbent damping material, disposed with respect to the cone, absorbs unwanted sound wave fronts, including the wave fronts produced at the inner concave surface of the cone, such that wave fronts propagated into the surrounding medium are time and phase-coherent. Additional absorbent damping material, disposed outwardly from and around a first portion of the outer surface of the cone, absorbs the coherent wave fronts produced at the first portion and which propagate in an undesired direction away from the listening area such that coherent wave fronts substantially hemispherical in shape propagate outwardly from a second portion of the outer surface of the cone into the listening area. In the listening area, the hemispherical wave fronts appear to be generated by a virtual source positioned behind the axis of the cone.

In a preferred embodiment of the present invention there is provided an inverted cone producing primarily low and medium frequencies. The cone includes an inner concave and an outer convex sound radiating surface between two coaxial ends. The outer surface includes a front portion directing sound waves in a desired direction toward the listening area and a rear portion directing sound waves in an undesired direction away from the listening area. The inverted cone has the property that the sound wave fronts propagate along the outer surface at a speed greater than the speed of sound in the surrounding air. Driving means coupled to the upper, smaller end of the cone produce vibrating movement of the cone. Absorbent damping material disposed with respect to the cone absorbs unwanted sound wave fronts, including the wave fronts produced at the inner concave surface of the cone. Additional absorbent damping material is disposed outwardly from and around the rear portion of the outer surface of the cone to absorb the coherent wave fronts at said rear portion such that coherent sound wave fronts substantially hemispherical in shape propagate outwardly from the front portion of the cone into the listening area. In the listening area these wave fronts appear to be generated by a virtual source positioned behind the axis of the cone. A high frequency speaker to supplement high frequencies is disposed above and adjacent to the smaller end of the cone and has a virtual source substantially on an axis that goes through the virtual source of the cone to produce time and phase-coherent hemispherical wave fronts which are concentric with the hemispherical wave fronts produced by the cone.

The above brief description, as well as further objects, features, and advantages of the present invention will be more fully understood by reference to the detailed description of the presently preferred but nonetheless illustrative embodiment in accordance with the present invention, when taken in conjunction with the accompanying drawing, wherein:

FIG. 1 a perspective view on a reduced scale of a speaker enclosure housing an illustrative form of the present invention;

FIG. 2 is a front elevation sectional view thereof with parts broken away and shown in section;

FIG. 3 an enlarged top sectional elevation view thereof taken substantially along the line 3—3 of FIG. 2 and looking in the direction of the arrows;

FIG. 4 is an enlarged fragmentary right side sectional elevation view showing the structure of the speaker compartment;

FIG. 5 is an enlarged fragmentary top view taken substantially along the line 5—5 of FIG. 4 and looking in the direction of the arrows;

FIG. 6 is a schematic representation of a front elevation view of the speakers of the present invention showing an exemplary wave front propagating toward the listening area;

FIG. 7 is a schematic representation of a top plan view of the speakers of the present invention showing the extent of propagation into the listening area from the high frequency speaker;

FIG. 8 is an enlarged bottom plan thereof;

FIG. 9 is an enlarged front elevational developed view of damping material located at the rear portion of the cone;

FIG. 10 is a schematic representation of the electrical connections within the present invention; and FIG. 11 is a schematic, reduced-size perspective representation showing a portion of a coherent wave front propagating into the listening area.

Figure 1:
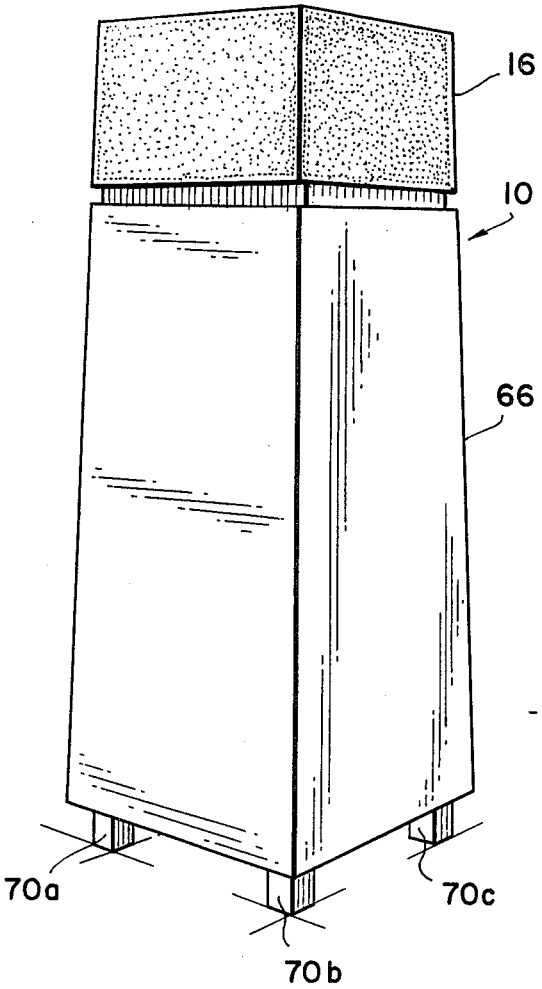

Referring now specifically to the drawing and first to FIGS. 1 through 6, in accordance with an illustrative embodiment demonstrating objects and features of the present invention, there is provided a loudspeaker apparatus generally designated by the reference numeral 10.

Figure 2:
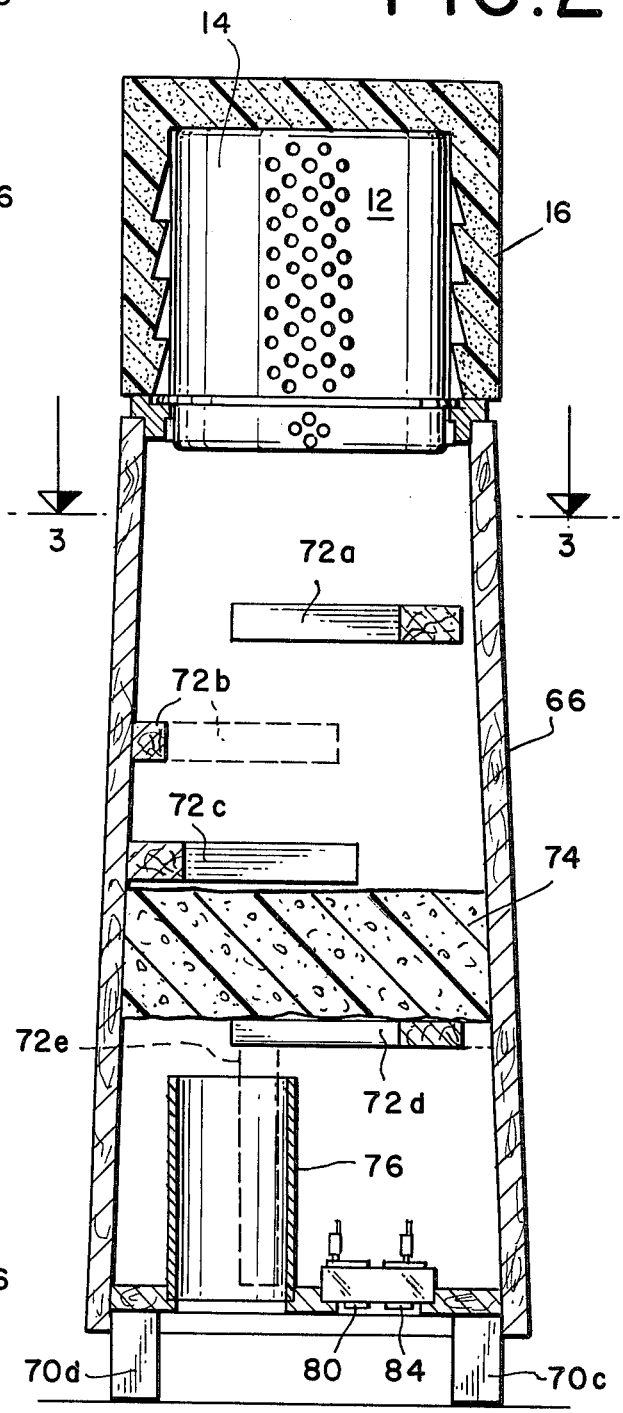

The loudspeaker apparatus 10 includes a speaker compartment 12 which is generally circular in cross section as best seen in FIG. 5 and which is enclosed within a foraminous steel cap 14 (FIG. 2). A removable grille 16 (see FIGS. 1 and 2) made of an acoustic transmitting material such as polyester double-knit cloth, is form-fitted to and covers the cap 14.

The speaker compartment 12 includes a 8″ inverted speaker 17 (see FIGS. 4 and 6) having a conical diaphragm or cone 18 which is a thin, curved sheet the surface of which is of a shape such as would be generated by the rotation of a straight or, alternatively, a curved line about an axis. Such a surface, generated by a curved line, is not a true cone, but is generally referred to as such in the industry and is included within the term "cone" as used herein. The cone 18 may be made of a stiff material, such as felted fiber, paper, a felted fiber and paper composition, or plastic. The cone 18 has a vertical axis and defines an inner concave sound radiating surface 18*a* and an outer convex sound radiating surface 18*b*. The cone 18 includes two coaxial ends; the upper, smaller end of the cone 18 is referred to as the driving circle 20 and the larger end of the cone 18 is referred to as the surround 22 (see FIG. 6). The angle $\theta$ of the cone 18 (see FIG. 6) will refer to the angle from a plane perpendicular to its vertical axis to the inner surface 18*a* at the surround 22. The surface of the cone 18 is curved to obtain more spherical-shaped wave fronts, such that the angle $\theta$ is substantially less than 50°, and in this particular exemplary embodiment approximates 30°.

Throughout the specification, the leftmost part of the loudspeaker apparatus 10, as seen in FIGS. 4, 5, 6 and 7, will be referred to as the "front"; the rightmost part of the apparatus as seen in FIGS. 4, 5, 6 and 7 will be referred to as the "rear" thereof; and the longitudinal direction will refer to the direction of the axis of the cone 18 and of the speaker 17.

The inverted cone 18 of this invention has the property that wave fronts propagate along its outer surface 18*b* at a speed which is greater than the speed of sound in air. In the exemplary embodiment described herein, the wave fronts produced at the driving circle 20 travel down the outer surface 18*b* at about twice the speed of sound in air and out into the air in a manner to produce a time and phase-"coherent" wave front. A "coherent" wave front means that the acoustic output of the cone approaches a wave front which would be produced by a sphere pulsating radially, with every portion of its surface simultaneously moving in and then out, in perfect phase with the input audio signal. This kind of sound output is analogous to coherent light as produced by a laser.

Phase response in a speaker is as important as frequency response. Without phase coherence, an instrument's fundamental frequency and harmonics could still be reproduced with undistorted frequency response, but they would not simultaneously arrive at the listener's ear. This is known as "time delay distortion." Such reproduced sounds are vaguely unnatural, without any definite sense of what is "wrong" with the sound.

In some instances, damping of an inverted cone, when operated in the manner described in the '873 patent, is principally internal to the cone material. For example, application of small amounts of compositions such as silicon rubber, plastic, flexible adhesive laminate glue and blotting paper suitably distributed on the outer surface 18*b* of the cone 18 may be used to absorb "unwanted" downward-directed wave fronts. Damping of such downward-directed wave fronts in the illustrative embodiment of the invention disclosed herein is principally accomplished by an elastomeric damping ring 24 which is circumferentially bonded at one end of the surround 22 (see FIG. 6) and for a distance radically inward thereof. Ring 24 can be made of an absorbent material, such as commercially available butyl-foam which absorbs a large proportion of the wave fronts, over substantially the entire audible frequency range, reaching the surround 22. The ring 24, which also seals the annular opening at the surround 22 against air leakage, is extremely flexible (having a suitable restoring force) to permit relatively free axial movement of the cone 18.

The velocity of wave front propagation along the outer surface 18*b* is supersonic, approximating in this specific embodiment of the invention two times the speed of sound in the surrounding air. Primarily the composition, the axial height and the angle of the cone 18 determine the actual wave front velocity along the outer surface 18*b*. For example, in designing a cone having a desired wave front velocity and considering only the cone composition, if plastic rather than felted fiber is used (the axial height and angle of each being equal) the resulting wave front velocity would be approximately ten percent higher in the plastic than in the felted fiber. The height and angle of the cone can, within limits, be varied according to design requirements to obtain the desired wave front velocity.

In one specific embodiment of the invention, the cone 18 produces primarily low and medium frequencies. More specifically, in the preferred embodiment described herein the low end of the frequency range is about 42 Hz. and the upper useful end is about 8,000 Hz. The upper useful end of the frequency range is generally limited by the cone composition and the responsiveness of the voice coil. The combination of the primarily low and medium frequencies produced, the damping ring 24 and additional damping means, i.e., damping panels 36 and 38 (see FIG. 4), discussed hereinafter, permit the cone 18 to be made of materials, disclosed hereinbefore, that are far easier and less expensive to produce than the metallic cone materials of the '873 patent. By modifying the cone composition and/or the voice coil, the cone 18 produces a different frequency response. In another embodiment of the subject invention, the cone 18, in combination with the other features of the subject invention, is capable of reproducing, with acceptable audio listening quality, the major portion of the audible frequency range. Thus the loudspeaker apparatus 10 is provided without the need for a high frequency speaker and at a reduced cost. If, however, a broader frequency range is desired, the loudspeaker apparatus 10 can include a high frequency speaker 52 as described hereinafter.

A conventional loudspeaker motor 26 (shown in schematic in FIG. 6) includes a magnet and a voice coil assembly positioned in the air gap of the magnet. Varying currents proportional to audio frequencies generated by a sound source such as a record or tape are suitably amplified and are applied to conventional input terminals 27 (see FIG. 10) of the voice coil which interacts with the magnetic field in the gap to cause the coil to undergo mechanical translational movement at a rate which is proportional to such audio frequencies. The direction of the movement of the voice coil is back and forth in a direction coincident with the longitudinal axis of the speaker 17 and proportional to the audio frequencies. Typically, the voice coil winding is glued to the outside of a thin paper cylinder or bobbin (not shown). One end of the cylinder is centered in the annular gap between the pole pieces of the magnet of motor 26 and the other end is centered at the driving circle 20. When the voice coil undergoes its longitudinal translational motion, and that motion is imparted in turn to the cone 18, audible sound is produced in the air. A steel basket enclosure 28 (see FIGS. 4 and 5) holds the driving circle 20 (see FIG. 6) and the motor 26, including the voice coil assembly and bobbin, centered in the speaker compartment 12, but permits the cone 18 and the voice coil assembly relatively free axial movement. At its lower end, the enclosure 28 is circumferentially bonded to the radially outward edge of the damping ring 24, which thereby holds it and the surround 22 centered in the compartment 12, but permits the cone 18 freedom to move axially by means of the ring 24.

Referring to FIG. 4, an absorbent damping panel 36, annular-shaped in cross section, is affixed around the side surface of the motor 26, extending, in the preferred embodiment, one-half inch radially outward thereof. A damping panel 38, generally semicircular in cross section, is affixed to the top surface of the motor 26, and is positioned above the front portion of the outer surface 18*b*, extending outwardly of the damping ring 24. The panels 36 and 38 absorb unwanted sound wave fronts reflected in a generally upwardly direction from the damping ring 24. Few, if any, of the wave fronts traveling radially outward from the cone 18 are absorbed by the panels 36 and 38. Both panels 36 and 38 are approximately three-quarters of an inch thick and are made of a material such as fluffy cellulose polyurethane batting, used, for example, in furniture construction and sold under the trademark TUFLEX.

Referring to FIGS. 4 and 9, an additional segment of damping material 40 is positioned against the rear portion of the inner surface of the cap 14. The damping material 40 absorbs the coherent wave fronts produced at the rear portion of the outer surface 18*b* which propagate in an undesired direction away from the listening area. The damping material 40 is made of a one-half inch thick segment of cellulose batting. A semicircular-shaped piece 40*a* of the damping material 40 (see FIG. 9) is positioned at the upper surface of the cap 14 to absorb the wave fronts directed thereto. The damping material 40 (shown in an uncurled or developed position in FIG. 9), covers approximately an angle of 200° at the bottom and 90° at the top of the cap 14, measured from the axis of the cone 18, and effectively absorbs the wave fronts produced at the rear portion of the outer surface 18*b*.

Accordingly, in this specific exemplary embodiment of the invention, the sound wave fronts, substantially hemispherical in shape, produced at the outer surface 18*b*, propagate outwardly in a desired direction toward the listening area over an angle of approximately 160° measured from an axis B (see FIG. 11) behind the axis of the cone 18. The significance of the axis B is discussed hereinafter. This 160° angle corresponds to the placement of the loudspeaker apparatus 10 along a wall of a room. If the loudspeaker apparatus 10 is to be placed in a corner location of a room, an optimum "front portion" might be designed to be 90° to minimize reflections from the surrounding walls. In general, the front portion of the outer surface 18*b*, which produces wave fronts directed to the listening area, may extend from an angle of 120° to an angle of 200°.

As discussed hereinbefore, since the cone 18 in the preferred embodiment of the present invention primarily produces low and medium frequencies, a conventional high frequency speaker or tweeter 52 supplements the high frequencies. The frequency response of the tweeter 52 ranges from approximately 1500 Hz. to 17,000 Hz. Referring in particular to FIGS. 4, 5, and 6, the tweeter 52, which receives varying currents proportional to audio frequencies generated by the sound source through input leads 54 (only one of which is shown in FIG. 4) and produces a sound wave front substantially hemispherical in shape, is mounted on the upper surface of the motor 26 at an angle to the axis of the cone 18. In general, the angle between the axes of the tweeter 52 and the cone 18 may be between 45° and 90°. In this illustrative embodiment of the invention, the preferred angle is 75°. If the angle between the axes is less than 45°, the wave fronts produced by the tweeter 52 are directed toward the top of the cap 14, and if greater than 90° are directed into and absorbed by the damping material 38. A cardboard reflector 56 (see FIG. 5) mounted at the base of the tweeter 52 improves the horizontal dispersion of the high frequency hemispherical waves, which would otherwise be directed into and absorbed by material 38, to the side edges of the reflector 56. The tweeter 52 is positioned above and behind the driving circle 20 of the cone 18 so that the hemispherical wave fronts produced are not blocked by the cone 18 in their outward travel to the listening area. As seen in FIG. 7, in this illustrative embodiment of the invention the tweeter 52 is designed to produce hemispherical wave fronts extending therefrom at an angle of approximately 160°. The precise position of the tweeter 52 with respect to the horizontal plane is important and is discussed in further detail hereinafter.

Figure 3:
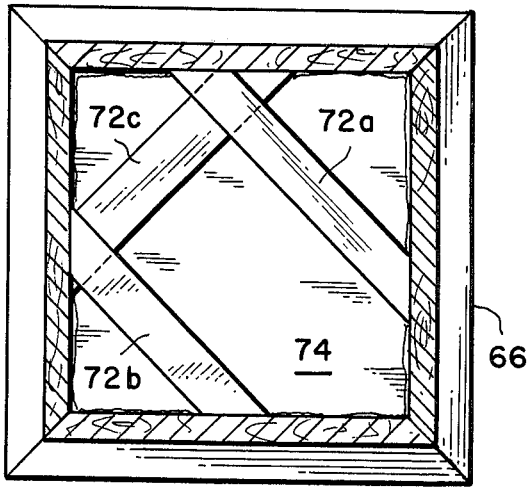

As best seen in FIG. 2, the speaker compartment 12 is centrally mounted upon and firmly attached to a baffle enclosure 66. The method of attachment is conventional, such as with the use of screws (not shown) threaded into openings 68*a* through 68*d* (FIG. 5) extending through the shoulder of the basket enclosure 28 and the baffle enclosure 66. The inverted cone 18 faces downward into the outwardly tapered enclosure 66 which is generally square in cross section (as best seen in FIG. 3) and is floor-supported by four legs 70*a* through 70*d*. The enclosure 66 may be made of any conventional non-resonating material such as flakeboard stock, and in the preferred embodiment is provided with an oiled wood finish veneer on its exterior surface. In this specific exemplary embodiment, the overall size of the enclosure 66 is 25.25″×11.5″×11.5″ at the bottom, tapering to 9.75″×9.75″ at the top. The baffle enclosure 66 is stiffened throughout by supporting ribs 72*a* through 72*e* (see FIGS. 2 and 3) to minimize the formation of undesired harmonic components therein.

An absorbent damping material 74 (see FIG. 2) absorbs non-coherent sound wave-fronts produced at the inner surface 18*a* of the cone 18 and directed into the interior of the baffle enclosure 66 to prevent standing waves from being formed inside the enclosure 66. High frequencies, i.e., those which are at least several hundreds of Hz., are removed by, although low frequency sound wave fronts pass through, the damping material 74. The damping material 74 which may be made of the same cellulose batting used for the damping materials 36, 38, and 40, occupies the entire interior of the baffle enclosure 66, at about half way down for a depth of three inches.

A bass-reflex port 76 (see FIGS. 2 and 8), also part of the enclosure 66, "tunes" the volume of air therein to a resonance frequency. That is, instead of the speaker apparatus 10 having a steep resonance maximum, two flat resonance curves, characteristic of two coupled oscillating systems, are obtained resulting in a more linear output. The length and diameter of the port 76 are selected such that the low frequencies which pass through the damping material 74 are delayed and inverted during the passage through the port 76 thereby rendering them in phase with the wave fronts produced from the outer surface 18*b* of the cone 18.

Referring to FIGS. 2, 8 and 10, mounted at the bottom surface of the baffle enclosure 66 are two conventional push terminals 80 and 82 for use in easy connection of the speaker wire to the loudspeaker system. Located adjacent to the terminals 80 and 82 are two conventional three-position (high, medium and low) treble contour switches 84 and 86 that control the "Q" of the system. The switches 84 and 86 allow the listener to adjust treble output for maximum performance, e.g., matching the speaker to the listening area. More precisely, the "Q" represents the impedance, i.e., the ratio of the acoustic reactance to the acoustic resistance of the system. Three-position switch 86 is connected through a conventional inductive/capacitance network 90, which eliminates subsonic frequencies to control the "Q" of the speaker 17. The switch 84 is connected to the tweeter 52 through a conventional resistance/capacitance network 88. A conventional electrical crossover network (not shown) may be desireable to supply, for example, only the frequencies of approximately 2,500 Hz. and above to the tweeter 52.

In operation, when an alternating current signal is applied to the input terminals 27 of the voice coil of the motor 26, through terminals 80 and 82 and the electronic network 90 (see FIG. 10), a vibrating force is applied to the cone 18 parallel to its longitudinal axis at the driving circle 20. The vibration at the driving circle 20 is transferred progressively as a wave front at a velocity significantly faster than the speed of sound in air and as a function of the geometry and properties of the cone 18 described hereinbefore. In this exemplary embodiment of the invention, as indicated hereinbefore, the wave front velocity along the outer surface 18*b* is approximately two times the velocity of sound in the surrounding air. The vibration, parallel to the axis of the cone 18, can be analyzed as having vector components both parallel and transverse to the outer surface 18*b*. Only the transverse vector of velocity is of interest since it produces the displacement of air or sound. The parallel component does not displace air and thus does not produce sound waves. The velocity of propagation varies considerably as the wave front travels from the driving circle 20 to the surround 22, usually increasing as it propagates. At the surround 22, a substantial portion of the wave energy is absorbed by the ring 24. Whatever wave energy is not absorbed by the ring 24 is reflected generally in the direction toward the motor 26 and produces delayed wave fronts directed toward the listening area. However, the major vector component of the delayed wave fronts will be in an upward direction and will have a minimal effect on the sound reaching the listening area. This undesireable effect is further minimized by the advantageous positioning, adjacent to and radially outward of the driving circle 20, of the panels of sound damping materials 36 and 38, which further absorb the undesired wave fronts.

Referring to FIG. 6, in the same period of time it takes wave 94 generated in the air at the driving circle 20 to travel radially outward in a generally horizontal direction to a point 98 on an arc A, wave 96 travels at approximately twice the speed of sound down the outer surface 18*b* of the cone 18 and travels outward in the air to a point 100 on the arc A. The geometry of the cone 18 is designed to maintain the exact relationship between the indirect longer path wave 96 and the direct sonic horizontal air wave 94. Since all the waves produced in the air meet on the arc A, a spherical wave front is generated which has virtually no time or phase errors.

To restrict the sound output to the front portion of the cone 18, the rear wave fronts are absorbed by the damping material 40 which extends for an angle, measured from the axis of the cone 18, of approximately 200° around the bottom of the inside surface of the cap 14. Referring to FIG. 11, the geometry and composition of the cone 18, and the positioning of the damping material, including the material 40 disposed around the rear portion of cap 14, are such that coherent wave fronts substantially hemispherical in shape propagate outwardly from the front of the cone 18 directing wave fronts in a desired direction into the listening area.

Referring further to FIG. 11, in the listening area, at a position on a horizontal axis C, at the front of the cone 18, it appears that the generated hemispherical wave fronts are centered on a longitudinal axis B, referred to as the virtual source of the cone 18, behind and parallel to the axis of the cone 18. Since there is a lag from the time when the varying currents proportional to the audio frequencies appear at the leads 27 to the voice coil of the motor 26 and the time the corresponding wave fronts appear at the outer surface 18*b*, caused by the inherent lag time of the voice coil, the source of the wave fronts appear to the listener to be positioned further away from the listening area than is in fact the case. As should be appreciated, the virtual source of the wave fronts are always behind the axis of the cone 18 regardless of the position from which the speaker 17 is viewed. By absorbing the coherent wave fronts produced at the rear portion of surface 18*b*, wave fronts substantially hemispherical in shape having a single-locus, virtual source are produced.

In this exemplary embodiment of the invention, since the cone 18 generates primarily low and medium frequencies, the tweeter 52 to supplement the highs is mounted above and behind the driving circle 20 of the cone 18. The tweeter 52 also has a virtual source which appears in the listening area to be located on the axis B (see FIG. 11), the virtual source of the speaker 17. To compensate for its much smaller lag time, the tweeter 52 is positioned somewhat forward of the virtual axis B, but behind the driving circle 20 of the cone 18. The precise location is a function of the lag time of the speaker 17 relative to the lag time of the tweeter 52. The result is that both the speaker 17 and tweeter 52 have virtual sources at the same position. Referring again to FIG. 6, in the same period of time it takes a wave 102 to travel to the point 98 on the arc A, a wave 104 travels to point 100 on the arc A. Thus, time and phase-coherent hemispherical wave fronts are produced by the tweeter 52 concentric with the hemispherical wave fronts produced by the cone 18 and directed to the listening area.

Accordingly, what has been provided in one specific exemplary embodiment of the invention are two speakers 17 and 52, the inverted simple construction cone 18 driven by a voice coil of substantial weight included in the motor 26 to produce primarily low and medium frequency sounds and the smaller high frequency speaker 52 to supplement the high frequency sounds. Wave fronts substantially spherical, instead of cylindrical, in shape, propagate radially outward from the outer surface of the cone 18. For this reason the speed of the wave fronts traveling down the outer surface 18*b* of the cone 18 need not be as high as that required in the type of cone disclosed in the '873 patent and the inverted speaker cone 18 of the subject invention may be made of such materials as paper, felted fiber, a paper and felted fiber combination or plastic, and not of expensive combinations including metal. Sound wave fronts in the surrounding air are produced and travel radially outward from the outer surface 18*b* of the cone 18, directed uniformly around the vertical axis of the cone 18. The cone 18 is not omnidirectional, having a front portion of its outer surface 18*b* directing wave fronts in a desired direction toward the listening area and having a rear portion directing wave fronts in an undesired direction away from the listening area. The sound-absorbent damping material 40 is disposed outwardly from and around the rear portion of the cone 18 and absorbs the sound wave fronts directed from the rear portion. Wave fronts produced by the inner concave surface 18*a* of the cone 18 are absorbed or restricted by the baffle enclosure 66.

When the wave fronts reach the surround 22, a substantial portion of the wave energy is absorbed in the damping ring 24. An object of the invention disclosed in the '873 patent is to absorb virtually all of the wave energy at the damping ring, since whatever wave energy is not absorbed in the ring is reflected and creates another coherent wave front that propagates generally upwardly from the larger end of the cone of the '873 patent. This unwanted upward radiation, i.e., unwanted in the sense that it produces delayed wave fronts in the air interfering with the coherent wave fronts directed to the listening area, is absorbed in the subject invention by additional absorbent damping materials 36 and 38 disposed adjacent to and radially outward of the smaller end of the cone 18. These additional damping materials 36 and 38 absorb little, if any, of the wave fronts propagated to the listening area.

In the listening area, the hemispherical wave fronts appear to be generated by a "virtual source" behind the axis of the cone 18. This effect is explained by the inherent lag time of the voice coil of the motor 26. In the past, this lag time has either been ignored or minimized by use of a low mass, high energy voice coil in conjunction with an inverted cone speaker, as for example, disclosed in the '873 patent. As should be appreciated, the virtual source of the wave front always appears to be behind the longitudinal axis of the speaker 17 regardless from which side the speaker 17 is viewed. Consequently, by absorbing the coherent wave fronts produced at the rear portion of the cone 18, a single locus virtual source is created.

Since the inverted cone 18 of the specific embodiment of the invention disclosed herein generates primarily low and medium frequencies, a tweeter to supplement the highs, which is of conventional design, is mounted above and behind the driving circle 20, but in front of the virtual source of the cone 18 with respect to the listening area such that the virtual source of the tweeter 52 is substantially on an axis that goes through the virtual source of the cone 18. The use of the inverted cone 18 for the woofer and mid-range functions permits the mounting of the tweeter 52 above and behind the driving circle 20 and near the virtual source of the cone 18 such that the tweeter 52 produces hemispherical wave fronts which are not blocked by the cone 18. The result of the speakers 17 and 52 having their virtual sources located substantially on the same axis is that concentric time and phase-coherent hemispherical wave fronts are produced directed to the listening area.

As will be readily apparent to those skilled in the art, the invention may be used in other specific forms or for other purposes without departing from its spirit or essential characteristics. The exemplary embodiment is, therefore, to be considered as illustrative and not restricted, the scope of the invention being indicated by the claims rather than by the foregoing description and all changes which come within the meaning and range of equivalents of the claims are therefore intended to be embraced therein.

What is claimed is:

1. A loudspeaker for directing time and phase coherent sound wave fronts, substantially hemispherical in shape, into a listening area comprising:

a conical diaphragm having two coaxial ends defining an inner concave and an outer convex sound radiating surface therebetween and having the property that wave fronts propagate along the outer radiating surface at a speed greater than the speed of sound in the surrounding medium;

driving means coupled to a first end of said diaphragm for producing vibrating movement of the diaphragm;

first damping means disposed with respect to the diaphragm to absorb unwanted wave fronts, including the wave fronts produced at the inner concave radiating surface, such that wave fronts propagated into the surrounding medium are time and phase-coherent; and second damping means disposed outwardly from and around a first portion of the outer surface to absorb the coherent wave fronts produced at said portion and propagating generally radially outward from the diaphragm in an undesired direction away from the listening area such that coherent wave fronts substantially hemispherical in shape propagate outwardly from a second portion of the outer surface into the listening area, said hemispherical wave fronts appearing in the listening area to be generated by a virtual source substantially on an axis positioned behind the axis of the diaphragm.

2. A loudspeaker as in claim 1 wherein the diaphragm produces primarily low and medium frequencies, and further including a high frequency speaker to produce supplementary high frequencies, said speaker disposed above and adjacent to the first end of the diaphragm and having a virtual source substantially on an axis that goes through the virtual source of the diaphragm to produce time and phase coherent hemispherical wave fronts concentric with the hemispherical wave fronts produced by the diaphragm.

3. A loudspeaker as in claim 2 wherein the high frequency speaker is disposed at an angle relative to the axis of the diaphragm, the angle between the driver and the diaphragm axes being between 45° and 90°.

4. A loudspeaker as in claim 1 wherein the first portion of the outer surface has an included angle between 120° and 200°.

5. A loudspeaker as in claim 1 wherein the conical diaphragm is made primarily of a material selected from the group consisting of felted fiber, paper, a combination of felted fiber and paper, or plastic.

6. A loudspeaker as in claim 1 wherein the second damping means comprises a plurality of layers of cellulose batting material.

7. A loudspeaker as in claim 2 wherein the sound radiation of the diaphragm is primarily at frequencies less than 8,000 Hz.

8. A loudspeaker for directing time and phase coherent sound wave fronts, substantially hemispherical in shape, into a listening area comprising:

a conical diaphragm producing primarily low and medium frequencies having two coaxial ends defining an inner concave and an outer convex sound radiating surface therebetween and having the property that wave fronts propagate along the outer radiating surface at a speed greater than the speed of sound in the surrounding medium;

means for producing vibrating movement of the diaphragm such that coherent wave fronts substantially hemispherical in shape propagate outwardly into the listening area and said hemispherical wave fronts appear in the listening area to be generated by a virtual source substantially on an axis positioned adjacent to the axis of the diaphragm; and a high frequency speaker to produce supplementary high frequencies, said speaker having a virtual source which is disposed substantially on an axis that goes through the virtual source of the diaphragm to produce time and phase coherent hemispherical wave fronts concentric with the hemispherical wave fronts produced by the diaphragm.

9. A loudspeaker as in claim 8 wherein the high frequency speaker is disposed at an angle relative to the axis of the diaphragm, the angle between the speaker and the diaphragm axes being between 45° and 90°.

10. A loudspeaker as in claim 8 wherein the conical diaphragm is made primarily of a material selected from the group consisting of felted fiber, paper, a combination of felted fiber and paper, or plastic.

11. A loudspeaker as in claim 8 wherein the sound radiation of the diaphragm is primarily at frequencies less than 8,000 Hz.

12. A loudspeaker for directing time and phase coherent sound wave fronts, substantially hemispherical in shape, into a listening area comprising:

a conical diaphragm producing primarily low and medium frequencies having two coaxial ends defining an inner concave and an outer convex sound radiating surface therebetween, said outer surface having a front portion directing sound waves in a desired direction toward the listening area and a rear portion directing sound waves in an undesired direction away from the listening area and having the property that wave fronts propagate along the outer radiating surface at a speed greater than the speed of sound in the surrounding medium;

driving means coupled to a first end of said diaphragm for producing vibrating movement of the diaphragm;

first damping means disposed with respect to the diaphragm to absorb unwanted sound wave fronts, including the wave fronts produced at the inner concave radiating surface;

second damping means disposed outwardly from and around the rear portion of the outer surface to absorb the coherent wave fronts produced at said rear portion such that coherent wave fronts substantially hemispherical in shape propagate outwardly from the front portion into the listening area, and said wave fronts appear in the listening area to be generated by a virtual source substantially on an axis positioned behind the axis of the diaphragm; and a high frequency speaker to produce supplementary high frequencies, said speaker disposed above and adjacent to the first end of the diaphragm and having a virtual source substantially on an axis that goes through the virtual source of the diaphragm to produce time and phase coherent hemispherical wave fronts concentric with the hemispherical wave fronts produced by the diaphragm.

13. A loudspeaker as in claim 12 wherein the high frequency speaker is disposed at an angle relative to the axis of the diaphragm, the angle between the driver and the diaphragm axes being 45° and 90°.

14. A loudspeaker as in claim 12 wherein the rear portion of the outer surface extends at an angle between 120° and 200°.

15. A loudspeaker as in claim 12 wherein the conical diaphragm is made primarily of a material selected from the group consisting of felted fiber, paper, a combination of felted fiber and paper or plastic.

16. A loudspeaker as in claim 12 wherein the second damping means comprises a plurality of layers of cellulose batting material.

17. A loudspeaker as in claim 12 wherein the sound radiation of the diaphragm is primarily at frequencies less than 8,000 Hz.

18. A loudspeaker for directing time and phase coherent sound wave fronts, substantially hemispherical in shape, into a listening area comprising:

a conical diaphragm producing primarily frequencies less than 8,000 Hz. having an upper, smaller end and a coaxial larger end defining an inner concave and an outer convex sound radiating surface, said outer surface having a front portion directing sound waves in a desired direction towards the listening area and a rear portion extending at an angle between 120° and 200° directing sound waves in an undesired direction away from the listening area, and having the property that wave fronts propagate along the outer radiating surface at a speed approximately two times the speed of sound in the surrounding air;

motor means coupled to the smaller end of the diaphragm for producing vibrating movement of the diaphragm;

absorbent damping material disposed with respect to the diaphragm to absorb unwanted sound wave fronts, including the wave fronts reflected at the larger end of the diaphragm and produced at the inner concave radiating surface;

additional absorbent damping material disposed outwardly from and around the rear portion of the outer surface to absorb the coherent wave fronts produced at said rear portion such that coherent wave fronts substantially hemispherical in shape propagate outwardly from the front portion into the listening area, and said wave fronts appearing in the listening area to be generated by a virtual source substantially on an axis positioned behind and parallel to the axis of the diaphragm;

a high frequency speaker to produce supplementary high frequencies, said speaker disposed above and adjacent to the smaller end of the diaphragm and having a virtual source substantially on an axis that goes through the virtual source of the diaphragm, said high frequency speaker disposed at an angle relative to the axis of diaphragm, the angle between the speaker and the diaphragm axes being between 45° and 90° to produce time and phase coherent hemispherical wave fronts concentric with the hemispherical wave fronts produced by the diaphragm.

* * * * *